US010851316B2

(12) United States Patent
Abudawoud et al.

(10) Patent No.: US 10,851,316 B2
(45) Date of Patent: Dec. 1, 2020

(54) CONVERSION OF CRUDE OIL TO AROMATIC AND OLEFINIC PETROCHEMICALS

(71) Applicant: Saudi Arabian Oil Company, Dhahran (SA)

(72) Inventors: Raed Abudawoud, Al-Khobar (SA); Thamer Mohammad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/845,826

(22) Filed: Dec. 18, 2017

(65) Prior Publication Data

US 2018/0187107 A1 Jul. 5, 2018

Related U.S. Application Data

(60) Provisional application No. 62/442,051, filed on Jan. 4, 2017.

(51) Int. Cl.
*C10G 69/04* (2006.01)
*C10G 67/00* (2006.01)
(Continued)

(52) U.S. Cl.
CPC ..... *C10G 69/04* (2013.01); *C10G 55/08* (2013.01); *C10G 67/00* (2013.01); *C10G 67/0418* (2013.01); *C10G 67/0445* (2013.01); *C10G 69/00* (2013.01); *C10G 69/10* (2013.01); *C10G 69/14* (2013.01); *C10G 2400/20* (2013.01); *C10G 2400/22* (2013.01); *C10G 2400/30* (2013.01)

(58) Field of Classification Search
CPC ..... C10G 69/04; C10G 69/06; C10G 69/08; C10G 69/10; C10G 67/04; B01J 8/04
See application file for complete search history.

(56) References Cited

U.S. PATENT DOCUMENTS 2,614,066 A * 10/1952 Cornell ..... C10G 49/007 208/212
2,910,426 A * 10/1959 Gluesenkamp ..... C10L 1/04 208/66

(Continued)

FOREIGN PATENT DOCUMENTS

WO WO2000009633 A1 2/2000
WO WO2009073436 A2 6/2009

(Continued)

OTHER PUBLICATIONS

International Search Report and Written Opinion in International Application No. PCT/US2017/067667 dated Apr. 9, 2018, 14 pages.

(Continued)

*Primary Examiner* — Lessanework Seifu
(74) *Attorney, Agent, or Firm* — Fish & Richardson P.C.

(57) ABSTRACT

A system includes a hydroprocessing zone configured to remove impurities from crude oil; a first separation unit configured to separate a liquid output from the hydroprocessing zone into a light fraction and a light fraction; an aromatic extraction subsystem configured to extract aromatic petrochemicals from the light fraction; and a fluid catalytic cracking unit configured to crack the heavy fraction into multiple products.

21 Claims, 2 Drawing Sheets

(51) Int. Cl.

| | |
|---|---|
| ***C10G 69/14*** | (2006.01) |
| ***C10G 55/08*** | (2006.01) |
| ***C10G 69/00*** | (2006.01) |
| ***C10G 67/04*** | (2006.01) |
| ***C10G 69/10*** | (2006.01) |

(56) References Cited

U.S. PATENT DOCUMENTS

| | | | | |
|---|---|---|---|---|
| 3,409,540 | A | 11/1968 | Gould et al. | |
| 3,533,938 | A | 10/1970 | Leas | |
| 3,702,292 | A | 11/1972 | Burich | |
| 3,726,789 | A * | 4/1973 | Kovach | C07C 5/2702 208/58 |
| 4,426,276 | A | 1/1984 | Dean et al. | |
| 4,786,400 | A * | 11/1988 | Farnsworth | C10G 11/18 208/155 |
| 5,091,351 | A | 2/1992 | Murakawa et al. | |
| 5,108,581 | A * | 4/1992 | Aldridge | C10G 1/086 208/108 |
| 9,096,806 | B2 | 8/2015 | Abba et al. | |
| 9,255,230 | B2 | 2/2016 | Shafi et al. | |
| 9,279,088 | B2 | 3/2016 | Shafi et al. | |
| 9,284,497 | B2 | 3/2016 | Bourane et al. | |
| 9,284,502 | B2 | 3/2016 | Bourane et al. | |
| 9,296,961 | B2 | 3/2016 | Shafi et al. | |
| 2005/0211603 | A1 | 9/2005 | Guillaume et al. | |
| 2008/0011644 | A1 | 1/2008 | Dean et al. | |
| 2008/0011645 | A1 | 1/2008 | Dean | |
| 2008/0194900 | A1 | 8/2008 | Bhirud | |
| 2010/0089795 | A1 | 4/2010 | Fujiyama et al. | |
| 2011/0083996 | A1 | 4/2011 | Shafi et al. | |
| 2011/0247500 | A1 | 10/2011 | Akhras et al. | |
| 2013/0220884 | A1 | 8/2013 | Bourane et al. | |
| 2013/0233766 | A1 | 9/2013 | Shafi et al. | |
| 2013/0248419 | A1 | 9/2013 | Abba | |
| 2016/0264886 | A1 | 9/2016 | Davydov | |

FOREIGN PATENT DOCUMENTS

| | | | |
|---|---|---|---|
| WO | WO2010009077 | A2 | 1/2010 |
| WO | WO2010009082 | A1 | 1/2010 |
| WO | WO2010009089 | A2 | 1/2010 |
| WO | 2015128045 | | 9/2013 |

OTHER PUBLICATIONS

International Search Report and Written Opinion in International Application No. PCT/US2017/067808 dated Mar. 12, 2018, 13 pages.

Gulf Cooperation Council Examination Report issued in GCC Application No. 2018-34568 dated Aug. 22, 2019, 4 pages.

Gulf Cooperation Council Examination Report issued in GCC Application No. 2018-34569 dated Nov. 26, 2019, 4 pages.

Gulf Cooperation Council Examination Report issued in GCC Application No. 2018-34568 dated Dec. 22, 2019, 6 pages.

Gulf Cooperation Council Examination Report issued in GCC Application No. 2018-39251 dated Jun. 1, 2020, 4 pages.

* cited by examiner

CONVERSION OF CRUDE OIL TO AROMATIC AND OLEFINIC PETROCHEMICALS

CLAIM OF PRIORITY

This application claims priority to U.S. Patent Application Ser. No. 62/442,051, filed on Jan. 4, 2017, the entire contents of which are incorporated here by reference.

BACKGROUND

Olefins (such as ethylene, propylene, butylene, and butane) and aromatics (such as benzene, toluene, and xylene) are basic intermediates that are widely used in the petrochemical and chemical industries. Thermal cracking, or steam pyrolysis, is sometimes used to form olefins and aromatics from feedstocks such as petroleum gases and distillates such as naphtha, kerosene, and gas oil.

SUMMARY

In an aspect, a system includes a hydroprocessing zone configured to remove impurities from crude oil; a first separation unit configured to separate a liquid output from the hydroprocessing zone into a light fraction and a heavy fraction; an aromatic extraction subsystem configured to extract aromatic petrochemicals from the light fraction; and a fluid catalytic cracking unit configured to crack the heavy fraction into multiple products.

Embodiments can include one or more of the following features.

The aromatic extraction subsystem comprises an aromatic extraction unit configured to separate aromatic petrochemicals of the light fraction from other components of the light fraction by one or more of solvent extraction and extractive distillation.

The aromatic extraction subsystem comprises a reformer configured to convert the light fraction into a reformate, and in which the aromatic extraction unit is configured to receive the reformate.

The reformate is rich in aromatic petrochemicals compared to the light fraction.

The aromatic extraction subsystem comprises a second separation unit configured separate an output from the reformer into the reformate and a byproduct fraction.

The system includes a gas separation unit configured to separate the byproduct fraction into hydrogen and light gases.

The hydrogen is provided to the hydroprocessing zone.

The light gases are provided to the pyrolysis section.

The reformer is configured to convert the light fraction into the reformate by one or more of hydrocracking, isomerization, dehydrocyclization, and dehydrogenation.

The reformer comprises a catalyst configured to catalyze production of aromatic petrochemicals.

The other components of the light fraction are returned to the hydroprocessing zone.

The aromatic extraction unit is configured to receive the light fraction from the second separation unit and to generate an output stream that is rich in aromatics compared to the light fraction.

The aromatic extraction subsystem comprises a reformer configured to convert the output stream into a reformate, and in which the aromatic extraction unit is configured to receive the reformate.

The system includes a third separation zone configured to separate an input stream of crude oil into a light crude fraction and a heavy crude fraction, in which the hydroprocessing zone is configured to remove impurities from the heavy crude oil fraction.

The system includes a fourth separation zone configured to separate an effluent from the hydroprocessing zone into a gas output from the hydroprocessing zone and the liquid output from the hydroprocessing zone.

The system includes a fifth separation unit configured to separate the heavy fraction into a first fraction and a second fraction, and in which the fluid catalytic cracking unit is configured to crack the first fraction and the second fraction into the multiple products.

The system includes a gas separation unit configured to separate a gas output from the hydroprocessing zone into hydrogen and light gases.

The hydrogen is provided to the hydroprocessing zone.

The first separation zone comprises a flash separation device.

The first separation zone comprises a separation device that physically or mechanically separates vapor from liquid.

The hydroprocessing zone comprises one or more of (i) a hydrodemetallization catalyst and (ii) a catalyst having one or more of hydrodearomatization, hydrodenitrogenation, hydrodesulfurization, and hydrocracking functions.

The system includes a purification unit configured to separate the cracked heavy fraction into multiple streams, each stream corresponding to one of the multiple products.

One of the streams corresponds to olefinic products and one of the streams corresponds to light catalytic cracked gasoline.

In an aspect, a method includes removing impurities from crude oil by a hydroprocessing process; separating a liquid output from the hydroprocessing process into a light fraction and a heavy fraction; extracting aromatic petrochemicals from the light fraction; and cracking the heavy fraction into multiple products by a fluid catalytic cracking process.

Embodiments can include one or more of the following features.

Extracting aromatic petrochemicals from the light fraction comprises separating the aromatic petrochemicals of the light fraction from other components of the light fraction by one or more of solvent extraction and extractive distillation.

Extracting aromatic petrochemicals from the light fraction comprises converting the light fraction into a reformate in a reformer.

The reformate is rich in aromatic petrochemicals compared to the light fraction.

The method includes separating an output from the reformer into the reformate and a byproduct fraction.

The method includes separating the byproduct fraction into hydrogen and light gases.

The method includes providing the hydrogen to the hydroprocessing zone.

The method includes providing the light gases to the pyrolysis section.

Converting the light fraction into a reformate comprises conducting one or more of hydrocracking, isomerization, dehydrocyclization, and dehydrogenation.

The method includes returning the other components of the light fraction to the hydroprocessing process.

Extracting aromatic petrochemicals from the light fraction comprises generating an output stream that is rich in aromatics compared to the light fraction.

The method includes separating an input stream of crude oil into a light crude oil fraction and a heavy crude oil fraction, and in which removing impurities from the crude oil comprises removing impurities from the heavy crude oil fraction.

The method includes separating an effluent from the hydroprocessing process into a gas and the liquid.

The method includes separating a gas output from the hydroprocessing process into hydrogen and light gases.

The method includes providing the hydrogen to the hydroprocessing process.

The method includes separating the cracked heavy fraction into multiple streams, each stream corresponding to one of the multiple products.

One of the streams corresponds to olefinic products and one of the streams corresponds to light catalytic cracked gasoline.

The systems and methods described here can have one or more of the following advantages. The approach to producing aromatics described here is a versatile approach that can produce multiple products, such as one or more of aromatic petrochemicals, olefinic petrochemicals, and light catalytic cracked gasoline. The production of aromatics such as benzene, xylene, toluene, or other aromatics during the direct conversion of crude oil to petrochemicals can be increased. The direct conversion of crude oil into aromatic and olefinic products and light catalytic cracked gasoline can enable complex distillation steps to be bypassed.

DETAILED DESCRIPTION

We describe here an integrated hydrotreating and fluid catalytic cracking approach to directly converting crude oil to petrochemicals, including olefinic petrochemicals such as ethylene and propylene; light catalyst cracked gasoline; and aromatic petrochemicals such as benzene, toluene, and xylene. In the approach to converting crude oil to petrochemicals described here, crude oil is processed in a hydroprocessing zone to remove impurities. A portion of the output from the hydroprocessing zone is processed to extract aromatic petrochemicals, and another portion of the output from the hydroprocessing zone is treated in a fluid catalytic cracking process to crack the portion into multiple products. The ability to generate aromatic petrochemicals from multiple portions of the output from the hydroprocessing zone, such as both heavy and light fractions of the crude oil, enables a high yield of aromatic petrochemicals to be achieved.

The term crude oil refers to whole crude oil from conventional sources, including crude oil that has undergone some pre-treatment. The term crude oil can refer to material that has been subjected to one or more of water-oil separation, gas-oil separation, desalting, and stabilization.

Figure 1:
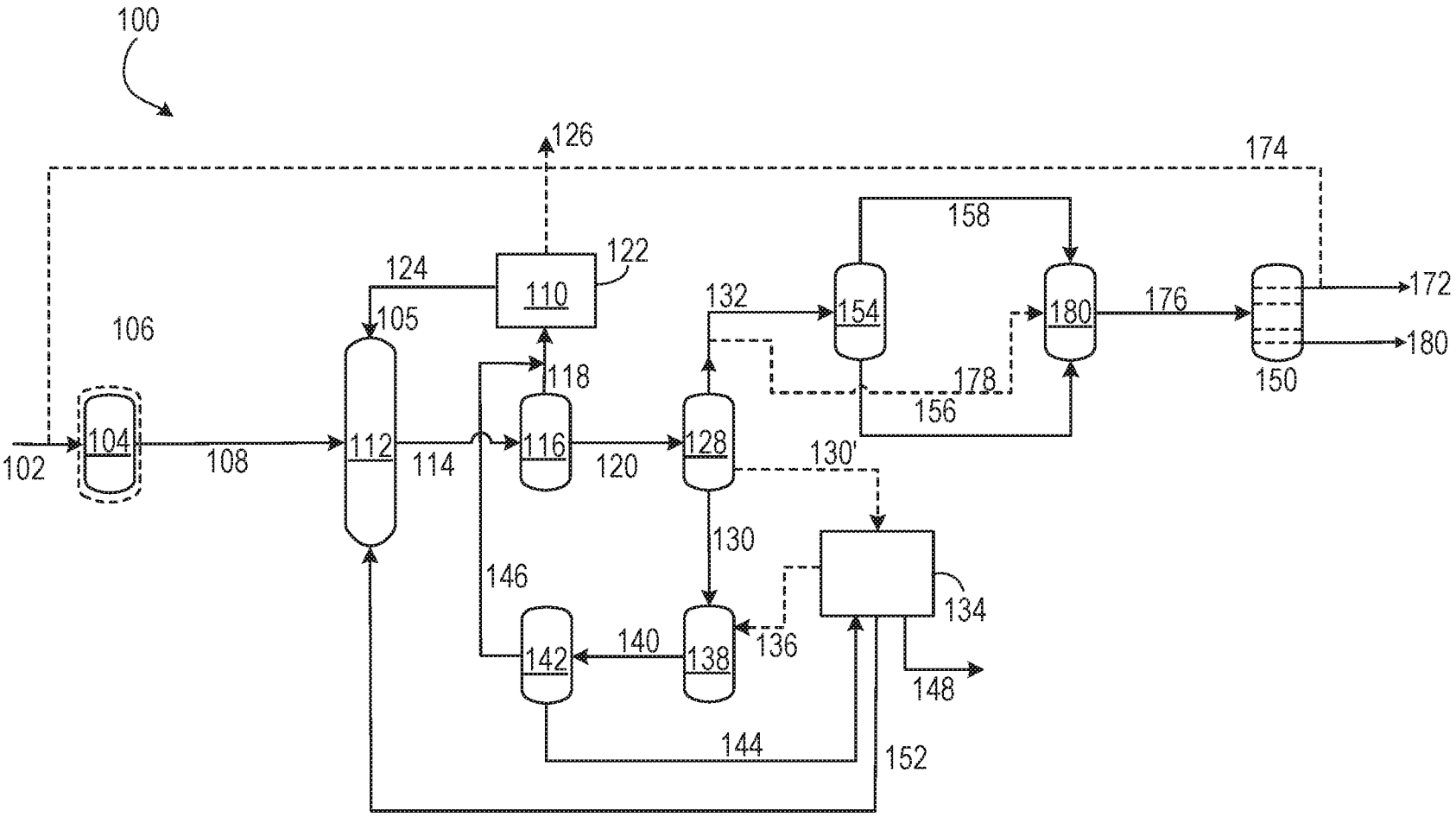
FIG. 1 is a block diagram of a conversion system.

Referring to FIG. 1, a conversion system 100 performs direct conversion of crude oil into petrochemicals, including both olefinic and aromatic petrochemicals and light catalyst cracked gasoline. An input stream of crude oil 102 is received into a separation unit 104 of the conversion system 100. The separation unit 104 separates the crude oil 102 into a light fraction 106, such as a gas, and a heavy fraction 108, such as a liquid. In some examples, the light fraction 106 can be a naphtha fraction. In some examples, the light fraction 106 can have a boiling point below about 65° C.

In some examples, the separation unit 104 can be a flash separation device such as a flash drum. For instance, the separation unit 104 can be a single stage separation device such as a flash separator with a cut point between about 150° C. and about 260° C. In some examples, the separation unit 104 can operate in the absence of a flash zone. For instance, the separation unit 104 can include a cyclonic phase separation device, a splitter, or another type of separation device based on physical or mechanical separation of vapors and liquids. In a cyclonic phase separation device, vapor and liquid flow into the device through a cyclonic geometry. The vapor is swirled in a circular pattern to create forces that cause heavier droplets and liquid to be captured and channeled to a liquid outlet. Vapor is channeled to a vapor outlet. The cyclonic separation device operates isothermally and with very low residence time. The cut point of the separation unit 104 can be adjusted based on factors such as the vaporization temperature, the fluid velocity of the material entering the separation unit 104, or both, or other factors. Further description of separation devices can be found in U.S. Patent Publication No. 2011/0247500, the contents of which are incorporated here by reference in their entirety.

The heavy fraction 108 is routed to a hydroprocessing zone 112 for removal of impurities such as sulfur, metals, nitrogen, or other impurities. The light fraction 106 is output from the conversion system 100 and used as fuel. In some configurations of the conversion system 100, the separation unit 104 is bypassed or eliminated and the input stream of crude oil 102 is received directly into the hydroprocessing zone 112.

The hydroprocessing zone 112 processes the heavy fraction 108 (or the crude oil 102, if the separation unit 104 is bypassed) along with hydrogen 105 and non-aromatic gases 152 returned from downstream processing. The hydroprocessing zone 112 can carry out one or more of the following processes: hydrodemetallization, hydrodearomatization, hydrodenitrogenation, hydrodesulfurization, and hydrocracking. The hydroprocessing zone 112 can include one or more beds containing an effective amount of hydrodemetallization catalyst. The hydroprocessing zone 112 can include one or more beds containing an effective amount of hydroprocessing catalyst having one or more of hydrodearomatization, hydrodenitrogenation, hydrodesulfurization and hydrocracking functions. In some examples, the hydroprocessing zone 112 can include multiple catalyst beds, such as two, three, four, five, or another number of catalyst beds. In some examples, the hydroprocessing zone 112 can include multiple reaction vessels each containing one or more catalyst beds of the same or different function. Further description of hydroprocessing zones can be found in United States Patent Publication Number 2011/0083996 and in PCT Patent Application Publication Numbers WO2010/009077, WO2010/009082, WO2010/009089 and WO2009/073436, the contents of all of which are incorporated here by reference in their entirety.

The hydroprocessing zone 112 can operate at a temperature between about 300° C. and about 450° C., such as about 300° C., about 350° C., about 400° C., about 450° C., or another temperature. The hydroprocessing zone 112 can operate at a pressure between about 30 bar and about 180 bar, such as about 30 bar, about 60 bar, about 90 bar, about 120 bar, about 150 bar, about 180 bar, or another pressure. The hydroprocessing zone 112 can operate with a liquid hour space velocity between about 0.1 $h^{-1}$ and about 10 $h^{-1}$, such as about 0.1 $h^{-1}$, about 0.5 $h^{-1}$, about 1 $h^{-1}$, about 2 $h^{-1}$, about 4 $h^{-1}$, about 6 $h^{-1}$, about 8 $h^{-1}$, about 10 $h^{-1}$, or another liquid hour space velocity. The liquid hour space velocity is the ratio of the flow rate of a reactant liquid through a reactor to the volume of the reactor.

A hydroprocessed effluent 114 is output from the hydroprocessing zone 112 and directed to a separation unit 116, such as a high pressure cold or hot separator. In some examples, the effluent 114 can be cooled in a heat exchanger (not shown) prior to the separation unit 116. The separation unit 116 separates the hydroprocessed effluent 114 into separator tops 118, which are generally gases, and separator bottoms 120, which are substantially liquid. In some examples, the separation unit 116 can be a flash separation device such as a flash drum. In some examples, the separation unit 116 can operate in the absence of a flash zone. For instance, the separation unit 116 can include a cyclonic phase separation device, a splitter, or another type of separation device based on physical or mechanical separation of vapors and liquids.

The separator tops 118 are routed to a gas separation and purification unit 122. The gas separation and purification unit 122 can include an amine component that purifies the separator tops 118 and a separation component that separates the separator tops 118 into hydrogen gas 124 and light gases 126, such as C1-C5 hydrocarbon gases, hydrogen sulfide, ammonia, or other light gases. The hydrogen gas 124 is recycled to the hydroprocessing zone 112. In some examples (not shown), the hydrogen gas 124 can be compressed in a compressor prior to being returned to the hydroprocessing zone 112. The light gases 126 can be recycled to the hydroprocessing zone 112 or output from the conversion system 110 for use as fuel gas or liquefied petroleum gas (LPG).

The separator bottoms 120, which contain the heavy bottoms of the hydroprocessed effluent 114, contain a reduced content of contaminants, such as metals, sulfur, or nitrogen; an increased paraffinicity; a reduced BMCI (Bureau of Mines Correlation Index); and an increased API (American Petroleum Institute) gravity as compared to the heavy fraction 108 of crude oil input into the hydroprocessing zone 112. The separator bottoms 120 are directed to a separation unit 128. In some examples, the separator bottoms 120 can be cooled in a heat exchanger (not shown) prior to the separation unit 128, which separates the separator bottoms 120 into a light fraction 130 and a heavy fraction 132. In some examples, the separation unit 128 can be a flash separation device such as a flash drum. In some examples, the separation unit 128 can operate in the absence of a flash zone. For instance, the separation unit 128 can include a cyclonic phase separation device, a splitter, or another type of separation device based on physical or mechanical separation of vapors and liquids. The separation unit 128 can include one or more separation devices that are able to fractionate a hydrocarbon cut similar to naphtha range and broader, such as a hydrocarbon cut that is rich in aromatic precursors. Further description of separation units can be found in U.S. Pat. Nos. 9,255,230, 9,279,088, 9,296,961, 9,284,497, 9,284,502, and U.S. Patent Publication Number 2013/0220884, the contents of all of which are incorporated here by reference in their entirety.

The light fraction 130 from the separation unit 128 includes hydrocarbon that was previously desulfurized and treated by the hydroprocessing zone 112. For instance, the light fraction 130 can include naphtha. The light fraction 130 can include hydrocarbon having an initial boiling point and a final boiling point of between about 150° C. and about 230° C., such as about 150° C., about 160° C., about 170° C., about 180° C., about 190° C., about 200° C., about 210° C., about 220° C., about 230° C., or another temperature. The heavy fraction 132 can include hydrocarbon having an initial boiling point between about 150° C. and about 230° C., such as about 150° C., about 160° C., about 170° C., about 180° C., about 190° C., about 200° C., about 210° C., about 220° C., about 230° C., or another temperature; and a final boiling point of 540° C. or higher. The initial and final boiling points of the light fraction 130, the heavy fraction 132, or both can depend on the type of crude oil 102 input into the conversion system 100.

In some cases, the light fraction 130 from the separation unit 128 is routed to a reformer 138, such as a naphtha reforming unit. In some cases, such as if the aromatic content of the light fraction is significant, the light fraction can be routed along an alternate path 130' to an aromatic extraction unit 134, discussed in greater detail infra, and an aromatic stream 136 output from the aromatic extraction unit 134 can be routed to the reformer 138. Because the light fraction 130 was treated in the hydroprocessing zone 112 upstream of the reformer 138, no hydrotreating of the light fraction 130 is performed before the light fraction 130 is fed into the reformer 138. The reformer 138, also discussed in greater detail infra, converts the light fraction 130 into a reformate that is rich in diverse aromatics, such as benzene, toluene, and xylene. In some examples, the reformer 138 enables a high production of xylene at the expense of a lower production of benzene. The reformer 138 can also produce hydrocarbon byproducts such as hydrogen gas and light hydrocarbon gases. The purposeful generation of aromatics by treating the light fraction 130 in the reformer 138 enables the overall yield of aromatics from the conversion system 100 to be increased.

An output stream 140 from the reformer 138, which contains the reformate and byproducts, is fed into a separation unit 142. In some examples, the separation unit 142 can be a flash separation device such as a flash drum. In some examples, the separation unit 142 can operate in the absence of a flash zone. For instance, the separation unit 142 can include a cyclonic phase separation device, a splitter, or another type of separation device based on physical or mechanical separation of vapors and liquids. The separation unit 142 separates the output stream 140 from the reformer 134 into a liquid stream 144 including the liquid reformate and a gas stream 146 including the hydrocarbon byproducts from the reformer 134, such as hydrogen gas and light hydrocarbon gases. The liquid stream 144 is routed to the aromatic extraction unit 134. The gas stream 146 is sent to the purification device 122 for separation into hydrogen 124 and light hydrocarbon gases 126.

The reformer 138 uses reactions such as one or more of hydrocracking, isomerization, dehydrocyclization, and dehydrogenation, to convert the light fraction 130 and the aromatic stream 136 into a reformate that is rich in aromatics such as benzene, toluene, and xylene. The reformer 138 can also generate hydrocarbon byproducts such as hydrogen and light hydrocarbon gases. The reformer can include a catalyst that is compatible with catalytic processes that maximize production of aromatics. For instance, the catalyst can be a mono- or bi-functional metal catalyst (for instance, one or more of platinum, palladium, rhenium, tin, gallium, bismuth, or other metal catalysts), a halogen containing catalyst, a catalyst employing a zeolite such as zeolite L or a ZSM-5 zeolite, a catalyst employing a crystalline or amorphous support that is mesoporous or microporous (for instance, an alumina, silica, or alumina silica support), or another type of catalyst that can maximize aromatics production. Examples of appropriate catalysts are described in U.S. Pat. No. 5,091,351 and PCT Patent Application Publication Number WO 2000/009633, the contents of both of which are incorporated here by reference in their entirety.

The operating conditions of the reformer 138 can be selected to maximize aromatics production. The reformer 138 can operate at a pressure between about 0.01 bar and about 50 bar, such as about 0.01 bar, about 0.1 bar, about 0.5 bar, about 1 bar, about 5 bar, about 10 bar, about 20 bar, about 30 bar, about 40 bar, about 50 bar, or another pressure. The molar ratio of hydrogen to hydrocarbon in the reformer 138 can be between about 1:1 and about 10:1, such as about 1:1, about 2:1, about 4:1, about 6:1, about 8:1, about 10:1, or another ratio. The reformer 138 can operate at a temperature between about 400° C. and about 600° C., such as about 400° C., about 450° C., about 500° C., about 550° C., about 600° C., or another temperature. The reformer can operate with a liquid hour space velocity between about 0.1 $h^{-1}$ and about 5 $h^{-1}$, such as about 0.1 $h^{-1}$, about 0.5 $h^{-1}$, about 1 $h^{-1}$, about 2 $h^{-1}$, about 3 $h^{-1}$, about 4 $h^{-1}$, about 5 $h^{-1}$, or another liquid hour space velocity.

The aromatic extraction unit 134 separates aromatics from reformate and pyrolysis gasoline using extraction techniques such as solvent extraction, extractive distillation, or other extraction techniques. The aromatic extraction unit 134 receives the liquid stream 144 including reformate from the separation unit 142 and optionally the light fraction 130' from the separation unit 128, and produces an enriched aromatics stream 148 that is rich in aromatics such as one or more of benzene, toluene, and xylene. The enriched aromatics stream 148 can be purified and collected by components external to the conversion system 100. Non-aromatics 152 exiting the aromatic extraction unit 134 can be recycled to the hydroprocessing zone 112 for further processing. The enriched aromatics stream 148 can have a high concentration of benzene, toluene, and xylene, and can be concentrated around the gasoline boiling range.

Returning to the separation unit 128, the heavy fraction 132 is fed into a separation unit 154. In the separation unit 154, the heavy fraction 132 is fractioned into a heavy fraction 156 and a light fraction 158. The light fraction 158 can have an initial boiling point of between about 150° C. and about 230° C., such as about 150° C., about 160° C., about 170° C., about 180° C., about 190° C., about 200° C., about 210° C., about 220° C., about 230° C., or another temperature; and a final boiling point of between about 150° C. and about 350° C., such as about 150° C., about 200° C., about 250° C., about 300° C., about 350° C., or another temperature. The heavy fraction 156 can have an initial boiling point of between about 150° C. and about 350° C., such as about 150° C., about 200° C., about 250° C., about 300° C., about 350° C., or another temperature; and a final boiling point as high as the crude oil end point (for instance, the Arabian light crude oil endpoint), such as between about 500° C. and about 600° C. In some examples, the separation unit 154 can be a flash separation device such as a flash drum. In some examples, the separation unit 154 can operate in the absence of a flash zone. For instance, the separation unit 154 can include a cyclonic phase separation device, a splitter, or another type of separation device based on physical or mechanical separation of vapors and liquids.

The heavy fraction 156 and the light fraction 158 are sent to a fluid catalytic cracking (FCC) unit 180 to be cracked into multiple products, including olefinic products and light catalytic cracked gasoline. The FCC 180 can include one or more downer reactors, such as one downer reactor, two downer reactors, or more than two downer reactors. The FCC unit 180 can include one or more riser reactors, such as one riser reactor, two riser reactors, or more than two riser reactors. The FCC unit 180 can implement a standard FCC process or a high-severity FCC process, in which the FCC unit 180 operates at higher reaction temperatures, higher ratios of catalyst to oil fractions, and shorter contact time. Description of example FCC units can be found in U.S. Patent Publication No. US 2008/0011644 and U.S. Patent Publication No. US 2008/0011645, the contents of both of which are incorporated here by reference in their entirety.

In the example of FIG. 1, the heavy fraction 156 is sent to the FCC downer reactor and the light fraction 158 is sent to the FCC riser reactor. In some examples, the heavy fraction can be sent to the FCC riser reactor and the light fraction can be sent to the FCC downer reactor. In some examples, the separation unit 154 can be bypassed and the heavy fraction 132 can be sent directly to the FCC unit 180, such as to the downer reactor or the riser reactor of the FCC unit 180, as shown in an optional stream 178.

An output product 176 from the FCC unit 180 is sent to a product purification section 150. In the product purification section 150, olefins such as ethylene and propylene are produced and output as an olefin stream 172. Light catalytic cracked gasoline (LCCG) is also produced in the product purification section 150 and output as an LCCG stream 170. The LCCG stream 170 can have a high octane number. In some examples, the LCCG stream 170 can be sent to a gasoline pool for further processing or sale. In some examples, the LCCG stream 170 can be recycled with the incoming crude oil 102, as shown in an optional recycle stream 174.

In some examples, selective hydroprocessing or hydrotreating processes can increase the paraffin content (or decrease the BMCI) of a feedstock (for instance, the heavy fraction 108 of the crude oil input stream 102) by saturation followed by mild hydro cracking of aromatics, especially polyaromatics. When hydrotreating a crude oil, contaminants such as metals, sulfur and nitrogen can be removed by passing the feedstock through a series of layered catalysts that perform the catalytic functions of one or more of demetallization, desulfurization, and denitrogenation. In some examples, the sequence of catalysts to perform hydrodemetallization (HDM) and hydrodesulfurization (HDS) can include a hydrodemetallization catalyst, an intermediate catalyst, a hydrodesulfurization catalyst, and a final catalyst.

The catalyst in the HDM section can be based on a gamma alumina support, with a surface area of between about 140 $m^2/g$ and about 240 $m^2/g$. This catalyst has a very high pore volume, such as a pore volume in excess of about 1 $cm^3/g$. The pore size can be predominantly macroporous, which provides a large capacity for the uptake of metals on the surface of the catalyst, and optionally dopants. The active metals on the catalyst surface can be sulfides of nickel (Ni), molybdenum (Mo), or both, with a molar ratio of Ni:(Ni+Mo) of less than about 0.15. The concentration of nickel is lower on the HDM catalyst than other catalysts as some nickel and vanadium is anticipated to be deposited from the feedstock itself, thus acting as a catalyst. The dopant can be one or more of phosphorus, boron, silicon and halogens, for instance, as described in U.S. Patent Publication Number US 2005/0211603, the contents of which are incorporated by reference here in their entirety. In some examples, the catalyst can be in the form of alumina extrudates or alumina beads. For instance, alumina beads can be used to facilitate un-loading of the catalyst HDM beds in the reactor as the metal can uptake will range between from 30 to 100% at the top of the bed.

An intermediate catalyst can be used to perform a transition between the hydrodemetallization and hydrodesulfurization functions. The intermediate catalyst can have intermediate metal loadings and pore size distribution. The catalyst in the HDM/HDS reactor can be an alumina based support in the form of extrudates, at least one catalytic metal from group VI (for instance, molybdenum, tungsten, or both), or at least one catalytic metals from group VIII (for instance, nickel, cobalt, or both), or a combination of any two or more of them. The catalyst can contain at least one dopant, such as one or more of boron, phosphorous, halogens, and silicon. The intermediate catalyst can have a surface area of between about 140 $m^2/g$ and about 200 $m^2/g$, a pore volume of at least about 0.6 $cm^3/g$, and mesoporous pores sized between about 12 nm and about 50 nm.

The catalyst in the HDS section can include gamma alumina based support materials with a surface area towards the higher end of the HDM range, such as between about 180 $m^2/g$ and about 240 $m^2/g$. The higher surface for the HDS catalyst results in relatively smaller pore volume, such as a pore volume of less than about 1 $cm^3/g$. The catalyst contains at least one element from group VI, such as molybdenum, and at least one element from group VIII, such as nickel. The catalyst also contains at least one dopant, such as one or more of boron, phosphorous, silicon, and halogens. In some examples, cobalt (Co) can be used to provide relatively higher levels of desulfurization. The metals loading for the active phase is higher as the desired activity is higher, such that the molar ratio of Ni:(Ni+Mo) is between about 0.1 and about 0.3 and the molar ratio of (Co+Ni):Mo is between about 0.25 and about 0.85.

A final catalyst can perform hydrogenation of the feedstock rather than having a primary function of hydrodesulfurization. In some examples, the final catalyst can replace the intermediate catalyst and the catalyst in the HDS section. The final catalyst can be promoted by nickel and the support can be wide pore gamma alumina. The final catalyst can have a surface area towards the higher end of the HDM range, such as between about 180 $m^2/g$ and about 240 $m^2/g$. The higher surface area for the final catalyst results in relatively smaller pore volume, such as a pore volume of less than about 1 $cm^3/g$.

Figure 2:
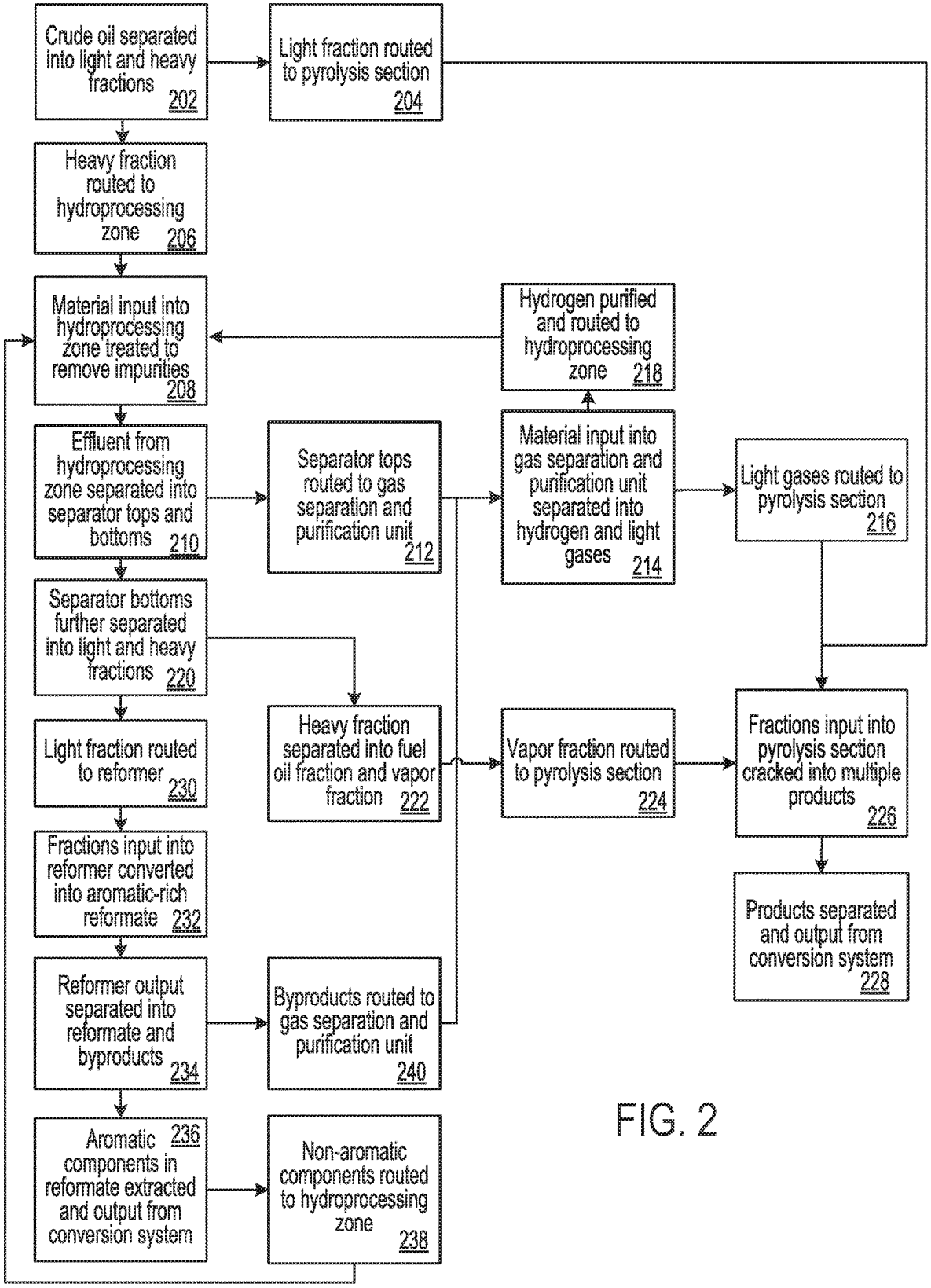
FIG. 2 is a flow chart.

Referring to FIG. 2, in an example process for directly converting crude oil to petrochemicals, crude oil is separated into a light fraction, such as a gas, and a heavy fraction, such as a liquid (202). The light fraction is output, for instance, to be used as fuel (204). The heavy fraction is routed to a hydroprocessing zone (206) and treated to remove impurities such as sulfur, metals, nitrogen, or other impurities (208).

A hydroprocessed effluent from the hydroprocessing zone is separated into separator tops, which are generally gases, and separator bottoms, which are substantially liquid (210). The separator tops are routed to a gas separation and purification unit (212) and separated into hydrogen gas and light gases, such as C1-C5 hydrocarbon gases (214). The light gases are output, for instance, to be used as fuel gas or liquefied petroleum gas (216). The hydrogen is purified and recycled to the hydroprocessing zone (218).

The separator bottoms of the hydroprocessed effluent are further separated into a light fraction and a heavy fraction (220). The heavy fraction is further separated into a heavy fraction and a light fraction (222). The vapor fraction is routed to a cracking section (224) and processed in a fluid catalytic cracking unit to be cracked into multiple products, such as light catalyst cracked gasoline and olefins (226). The products are separated and output from the conversion system (228).

The light fraction of the separator bottoms is routed to a reformer (230). The components input into the reformer are converted into a reformate that is rich in aromatics, such as benzene, toluene, and xylene (232). The reformate is separated from byproducts generated by the reformer (234). Aromatic components in the reformate are extracted and output from the conversion system (236). Non-aromatic components in the reformate are recycled to the hydroprocessing zone (238). Byproducts generated by the reformer are routed to the gas separation and purification unit (240).

Other implementations are also within the scope of the following claims.

What is claimed is:

1. A system comprising:

a crude separation unit configured to separate an input stream of crude oil into outputs consisting of a light fraction and a heavy fraction;

a hydroprocessing zone configured to remove impurities from the heavy fraction;

a first separation unit configured to separate a hydroprocessed effluent from the hydroprocessing zone into separator tops and separator bottoms;

an aromatic extraction subsystem configured to extract aromatic petrochemicals from the separator tops before feeding the light fraction to a reformer; and a fluid catalytic cracking unit configured to crack the separator bottoms into multiple products.

2. The system of claim 1, in which the aromatic extraction subsystem comprises an aromatic extraction unit configured to separate aromatic petrochemicals of the separator tops from other components of the separator tops by one or more of solvent extraction and extractive distillation.

3. The system of claim 2, in which the aromatic extraction subsystem comprises a reformer configured to convert the separator tops into a reformate, and in which the aromatic extraction unit is configured to receive the reformate.

4. The system of claim 3, in which the reformate is rich in aromatic petrochemicals compared to the separator tops.

5. The system of claim 3, in which the aromatic extraction subsystem comprises a second separation unit configured separate an output from the reformer into the reformate and a byproduct fraction.

6. The system of claim 5, comprising a gas separation unit configured to separate the byproduct fraction into hydrogen and light gases.

7. The system of claim 6, in which the hydrogen is provided to the hydroprocessing zone.

8. The system of claim 3, in which the reformer is configured to convert the separator tops into the reformate by one or more of hydrocracking, isomerization, dehydrocyclization, and dehydrogenation.

9. The system of claim 3, in which the reformer comprises a catalyst configured to catalyze production of aromatic petrochemicals.

10. The system of claim 2, in which the other components of the separator tops are returned to the hydroprocessing zone.

11. The system of claim 5, in which the aromatic extraction unit is configured to receive the reformate from the second separation unit and to generate an output stream that is rich in aromatics compared to the reformate.

12. The system of claim 11, in which aromatic extraction subsystem comprises a reformer configured to convert the output stream into the reformate, and in which the aromatic extraction unit is configured to receive the reformate.

13. The system of claim 1, comprising a fourth separation zone configured to separate an effluent from the hydroprocessing zone into a gas output from the hydroprocessing zone and the liquid output from the hydroprocessing zone.

14. The system of claim 1, comprising a fifth separation unit configured to separate the heavy fraction into a first fraction and a second fraction, and in which the fluid catalytic cracking unit is configured to crack the first fraction and the second fraction into the multiple products.

15. The system of claim 1, comprising a gas separation unit configured to separate a gas output from the hydroprocessing zone into hydrogen and light gases.

16. The system of claim 15, in which the hydrogen is provided to the hydroprocessing zone.

17. The system of claim 1, in which the first separation zone comprises a flash separation device.

18. The system of claim 1, in which the first separation zone comprises a separation device that physically or mechanically separates vapor from liquid.

19. The system of claim 1, in which the hydroprocessing zone comprises one or more of (i) a hydrodemetallization catalyst and (ii) a catalyst having one or more of hydrodearomatization, hydrodenitrogenation, hydrodesulfurization, and hydrocracking functions.

20. The system of claim 1, comprising a purification unit configured to separate the cracked heavy fraction into multiple streams, each stream corresponding to one of the multiple products.

21. The system of claim 20, in which one of the streams corresponds to olefinic products and one of the streams corresponds to light catalytic cracked gasoline.

* * * * *